United States Patent [19]

Zawislak

[11] 4,052,762

[45] Oct. 11, 1977

[54] BABY LIFE PRESERVER

[75] Inventor: Phyllis D. Zawislak, Huntington, N.Y.

[73] Assignee: The Raymond Lee Organization, Inc., New York, N.Y. ; a part interest

[21] Appl. No.: 695,731

[22] Filed: June 14, 1976

[51] Int. Cl.[2] ..... B63C 9/10

[52] U.S. Cl. ..... 9/337; 9/330; 9/342

[58] Field of Search ..... 9/329, 334, 336–339, 9/340, 342, 330, 341

[56] References Cited

U.S. PATENT DOCUMENTS

| | | | |
|---|---|---|---|
| 3,050,753 | 8/1962 | Baker | 9/337 |
| 3,144,668 | 8/1964 | Palesotti | 9/334 |
| 3,616,475 | 11/1971 | Lewis | 9/340 |

*Primary Examiner*—Trygve M. Blix
*Assistant Examiner*—Sherman D. Basinger
*Attorney, Agent, or Firm*—Howard I. Podell

[57] ABSTRACT

A life preserver, shaped for use on a child or baby consisting of floatable plastic foam sections fitted together to form an enclosed vest with the bottom of the foam sections joined to a webbing formed with a pair of holes for the feet of the wearer and with a pair of straps fastened to the top front of the vest and the back section. The back section of the vest may be separated or joined together by snap fasteners and the upper sections of the vest are thicker than the lower sections of the vest to provide a greater degree of buoyancy to the head of the wearer so that he floats vertically like a buoy with head out of the water, when strapped in the device.

1 Claim, 5 Drawing Figures

BABY LIFE PRESERVER

SUMMARY OF THE INVENTION

My invention is a life preserver, shaped for use on a child or baby consisting of floatable plastic foam sections fitted together to form an enclosed vest with the bottom of the foam sections joined to a webbing formed with a pair of holes for the feet of the wearer and with a pair of straps fastened to the top front of the vest and the back section. The back section of the vest may be separated or joined together by snap fasteners and the upper sections of the vest are thicker than the lower sections of the vest to provide a greater degree of buoyancy to the head of the wearer so that he floats vertically like a buoy with head out of the water, when strapped in the device.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
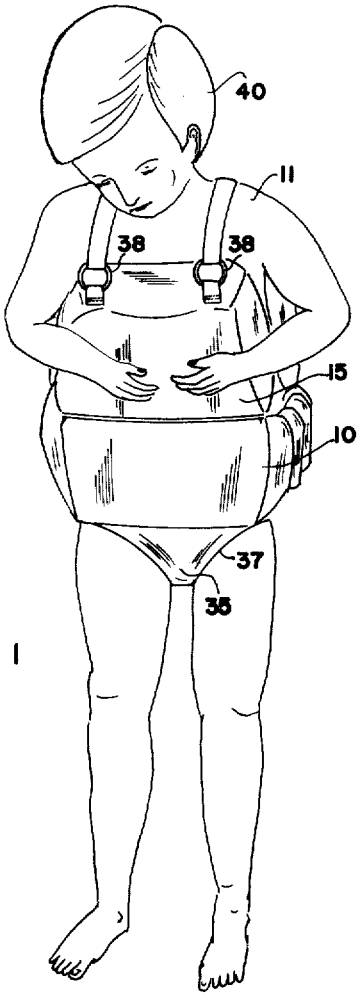
FIG. 1 is a perspective view of the invention in use.
Figure 2:
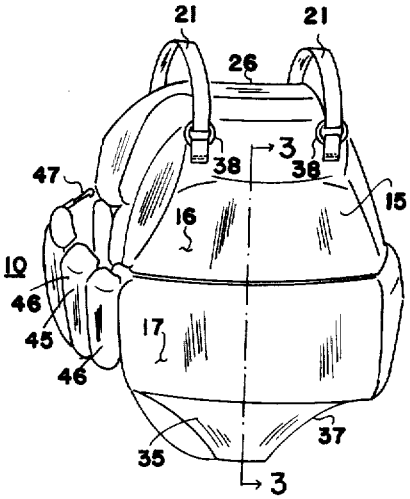
FIG. 2 is a perspective front view of the invention.
Figure 5:
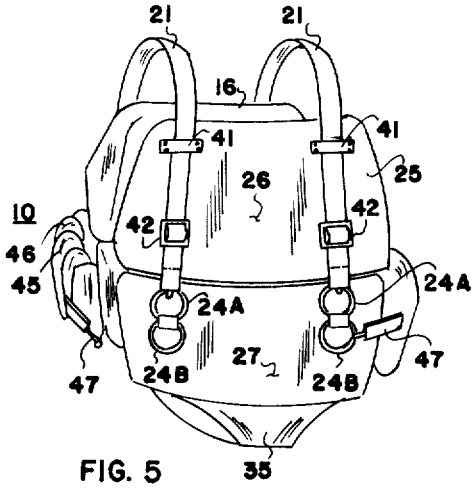
FIG. 5 is a rear perspective view of the invention.
Figure 3:
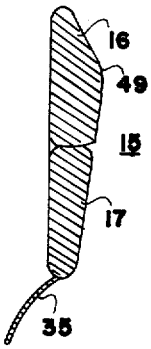
FIG. 3 is a side sectional view of the front section of the invention, taken along line 3-3 of FIG. 2.

Turning now descriptively to the drawings, in which similar reference characters denote similar elements throughout the several views, FIGS. 1–3 and 5 illustrate the invention in the form of a flotation vest 10 that may be fitted about the body of a baby or child 11. The vest is formed of semi-rigid sections of foam plastic such as styrofoam that are joined together.

The front portion 15 of the vest 10 is formed of an upper section 16 joined to a lower section 17, and the back portion 25 is formed of an upper section 26 which is joined to a lower section 27.

A pair of spaced straps 21 are each fastened by an individual clasp 38 to the upper front section 16 and each led through an individual fastening loop 41 on the upper back section 26 to an individual clasp 24A fastened on the lower back section 27, with each strap 21 fitted with a length adjustment buckle 42.

A flexible mid-section 45 of joined articulated section of foam plastic 46 is fitted to each side of the lower front section 17 to serve as a flotation belt, with a detachable clip fastener 47 fitted on the free end of each mid-section 45 adaptable for detachable fastening to one of a pair of clasps 24B each of which is fastened adjacent a clasp 24A.

A section of webbing 35 joins the bottom edges of lower front section 17 to lower rear section 27 with webbing 35 formed with two leg holes 37.

Figure 4:
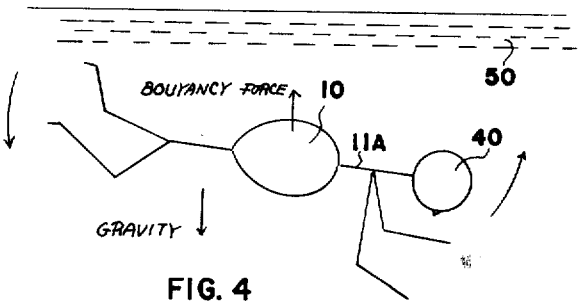
FIG. 4 is a schematic diagram of the forces operating on the invention in use.

Each upper section 26 and 16 is of greater thickness and volume than the adjoining lower section 27 and 17. Each upper section 26 and 16 is externally tapered from the respective upper and lower ends so as to bulge at it's mid-section 49. Lower sections 27 and 17 are of tapered thickness so that each lower section is thicker and more buoyant at its upper end than at its lower end. Consequently the vest, when strapped on a user 11A in the water 50 produces a buoyancy force, the center of which is nearer to the head 40 than is the center of gravity of the combination of vest and user, as shown in FIG. 4, so as to produce a torque force to rotate a prone user 11A into the upright position, with the user's head 40 out of water.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A child's life preserver formed of buoyant foam plastic sections joined together to form a vest and shaped so in the worn position the upper sections of the vest are of greater volume than the lower sections of the vest to provide a greater degree of buoyancy to the upper section of the body of the wearer and to cause the wearer to float in a vertical upright position in the water, comprising:

a front section and a rear section, each formed of an upper section of a shaped semi-rigid block of foam plastic material joined to a lower section of a shaped block of similar material, with a section of shaped webbing joined at opposed ends to the bottom edges of the two said lower sections, said webbing formed with shaped openings so as to fit about the legs of a wearer, with each said upper section of greater thickness and volume than each said lower section, with a flexible articulated section of foam plastic shaped as a belt fitted at a first end to each of two opposed sides of the front lower section, with each of said articulated sections fitted at a second end with clip means for detachably fastening to an individual clasp fastened on the exterior of the back lower section, a pair of spaced straps each fastened at a first end by an individual clasp to the exterior of the front upper section, and each said strap extending in slidable relation to an individual fastener fixed on the exterior of the rear upper section and with the second end of each said strap fixed to a clasp fastened to the exterior of the back lower section, such that in the worn position each strap fits about a shoulder of the wearer and each articulated belt section fits about a side of the wearer to hold the back section and the front section in their respective positions about the wearer.

* * * * *